US006120276A

United States Patent [19]

Balk

[11] Patent Number: 6,120,276

[45] Date of Patent: Sep. 19, 2000

[54] APPARATUS FOR SPINNING CORE FILAMENTS

[75] Inventor: Hermann Balk, Troisdorf, Germany

[73] Assignee: Reifenhauser GmbH & Co. Maschinenfabrik, Troisdorf, Germany

[21] Appl. No.: 09/182,035

[22] Filed: Oct. 29, 1998

[30] Foreign Application Priority Data

Nov. 15, 1997 [DE] Germany ..... 197 50 724

[51] Int. Cl.[7] ..... D01D 5/34

[52] U.S. Cl. ..... 425/131.5; 425/463; 425/72.2; 425/192 S; 264/172.15

[58] Field of Search ..... 425/131.1, 131.5, 425/378.2, 463, 192 S, 72.2; 264/172.14, 172.13, 172.15

[56] References Cited

U.S. PATENT DOCUMENTS

| | | | |
|---|---|---|---|
| 3,692,423 | 9/1972 | Okamoto et al. | 425/131 |
| 4,406,850 | 9/1983 | Hills | 264/171 |
| 4,717,325 | 1/1988 | Fujimara et al. | 425/131.5 |
| 4,846,653 | 7/1989 | Beck et al. | 425/131.5 |
| 5,035,595 | 7/1991 | Nakajima et al. | 425/131.5 |

FOREIGN PATENT DOCUMENTS

| | | |
|---|---|---|
| 0 383 602 | 8/1990 | European Pat. Off. . |
| 0 596 248 A2 | 5/1994 | European Pat. Off. . |
| 0 786 543 | 7/1997 | European Pat. Off. . |
| 39 15 819 | 11/1990 | Germany . |
| 02 182 911 | 7/1990 | Japan . |

*Primary Examiner*—Harold Pyon
*Assistant Examiner*—Emmanuel Luk
*Attorney, Agent, or Firm*—Herbert Dubno

[57] ABSTRACT

Core filaments for the formation of a fleece are formed in a spinneret assembly which has a wide slit extrusion die provided with two outlet slits for different thermoplastic synthetic resins. Below the die, a distribution plate has two sets of feed bores which deliver synthetic resin from the two sets of bores to a core-forming plate directly beneath the distribution plate and a spinneret plate below the core-forming plate whose spinneret bores are aligned with core-forming bores in the core-forming plate.

3 Claims, 4 Drawing Sheets

APPARATUS FOR SPINNING CORE FILAMENTS

FIELD OF THE INVENTION

The present invention relates to an apparatus for producing core filaments and, more particularly, for producing a curtain of spun filaments or so-called bicomponent filaments from two different thermoplastic synthetic resins in a core/sheath structure.

BACKGROUND OF THE INVENTION

In the spinning of filaments from thermoplastic synthetic resins, it is known to force a thermoplastic synthetic resin through the orifices of a spinneret, thereby generating a curtain of filaments. These filaments can be collected on, for example, a perforated surface below which suction can be generated to produce a jumble of such filaments in the formation of so-called spun bond fleece. The collecting surface may be a conveyer and the fleece which is thus formed can be calendared with the filaments being bonded randomly to one another, e.g. by fusion at the temperature of the filaments. In the production of spun bond fleece, the filaments are usually drawn, e.g. by entrainment in a process air flow and can be cooled between their emergence from the spinneret orifices and their collection on the perforated surface. Another method of forming a fleece from filaments generated in a spinneret is the melt-blown process, whereby the filaments are away from the spinneret torn and from fibers as the filaments merge from the spinneret and the fibers are collected on a perforated surface which can be a conveyor.

It is also known to produce such filaments as bicomponent filaments from two different synthetic resins, thereby gaining advantages of both. For example, the spinning of bicomponent filaments with a core/sheath structure from two different thermoplastic synthetic resins has been taught in DE 37 10 946 A1. The filaments have a core usually of one synthetic resin surrounded by and bonded to a sheath of the other synthetic resin and may have advantages of both. For example, the core synthetic resin can contribute greater strength whereas the sheath synthetic resin can contribute surface characteristics which maybe desirable. In any case, the filaments have advantages which cannot be obtained with either of the two synthetic resins alone.

In practice it has been found that the nozzle or spinneret system required for producing such core/sheath filaments is relatively expensive and not always suitable for use in the production of spun fleeces or webs, especially because the bicomponent filaments cannot be produced with total uniformity throughout the filament curtain and because there are differences in the characteristics of the filaments from one filament group to another.

It is important that the filaments have more or less uniform characteristics over the entire array of spinneret orifices and especially over the entire width of the fleece which is to be produced. Reference may also be had to DE 37 38 326 C2.

OBJECTS OF THE INVENTION

It is the principal object of the present invention to provide an improved apparatus for producing core/sheath filaments, especially for spun fleece production.

Still another object of the invention is to provide an improved spinneret assembly which can be of relatively low cost and nevertheless can generate an array or curtain of bicomponent filaments with a high degree of uniformity.

Still another object of the invention is to provide an apparatus for producing filaments for a spun fleece with a core/sheath structure and which will be free from drawbacks of earlier systems.

SUMMARY OF THE INVENTION

These objects and others which will become apparent hereinafter are attained, in accordance with the invention in an apparatus for spinning a plurality of core filaments from two different thermoplastic synthetic resins, the apparatus comprising:

- a two-channel wide-slit extrusion die connected to sources of the thermoplastic synthetic resins and having two mutually parallel outlet slits opening downwardly at an underside of the two-channel wide-slit extrusion die and each discharging a respective one of the synthetic resins;
- a distribution plate affixed to the underside of the two-channel wide-slit extrusion die and formed with two sets of feed bores for conveying flows of the respective synthetic resins, the feed bores of each set having inlet ends communicating with the respective outlet slits;
- a core-forming plate affixed at an underside of the distribution plate and formed with an array of throughgoing core-forming bores opening at an upper side of the core-forming plate into at least one upper distribution chamber, one of the sets of feed bores opening into the upper distribution chamber; and
- a spinneret plate affixed at an underside of the core-forming plate and provided with an array of throughgoing filament-forming bores aligned with respective ones of the core-forming bores whereby the core-forming bores extrude respective core-forming strands of the synthetic resin of the one of the sets of feed bores into the respective filament-forming bores, the filament-forming bores being of larger diameter than the core-forming bores and opening at a lower distribution chamber extending over the entire array and located at an upper side of the spinneret plate, the other of the sets of feed bores being extended beyond the core-forming plate to open into the lower distribution chamber whereby synthetic resin from the other of the sets of bores is extruded around the core-forming strands to form core filaments emerging from the filament-forming bores below the spinneret plate.

In the system of the invention, the wide-slit die which serves as the initial stage in the spinneret assembly or apparatus, has two mutually parallel linearly extending outlet slits for the respective synthetic resin melts and, on the underside of this die, a distributor plate is provided with feed bores for the two synthetic resin melts. Below the distributor plate, there is mounted the core-forming plate with throughgoing bores in an array which is preferably rectangular and at least has the bores spaced apart in a longitudinal direction and in a transverse direction uniformly, i.e. in a uniform array or raster.

On the underside of this plate, a spinneret plate is provided with a corresponding array of bores of a larger diameter than the core-forming bores and so that the axes of each core forming bore and a respective larger bore coincide.

The inlets of the feed bores for the synthetic resin melt adapted to form the cores, open in the region of one of the slits while the inlets for the feed bores adapted to form the sheaths open in the region of the other of the slits. The outlets of the feed bores for the core-forming material open into the core-forming bores, e.g. via an upper distribution chamber so that the core-forming strands pass downwardly into the larger diameter bores of the spinneret plate. The outlets of the feed bores for the sheath material open into a distributor chamber between the spinneret plate and the core-forming plate so that as the core strands pass through the larger diameter bores, they entertain the synthetic resin materials of the sheets through these larger diameter bores and thereby forming the filaments.

The invention is based upon the fact that two apertured plates can be attached beneath a distributor plate which, in turn, is affixed on the underside of a wide-slit die to generate bicomponent core/sheath filaments with a high degree of uniformity over the entire width of the spinneret assembly. The fleece or web which is formed by collecting the filaments for fibers formed from these filaments below the spinneret assembly has a correspondingly improved quality.

Preferably, the core-forming plate is set into a recess in the distributor plate and the assembly of spinneret, core-forming and distributor plates is affixed by common bolts or screws to the wide-slit die.

The core-forming and spinneret bores are preferably formed in a rectangular raster or array.

It has been found that the assembly is of simple and efficient design when the outlets of the feedbores for the core-forming melt are located in transverse rows between two core-forming bores and/or the outlets for the feedbores for the sheath forming melt lie in transverse rows between the transverse rows of spinneret bores between each two neighboring spinneret bores in the longitudinal direction.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
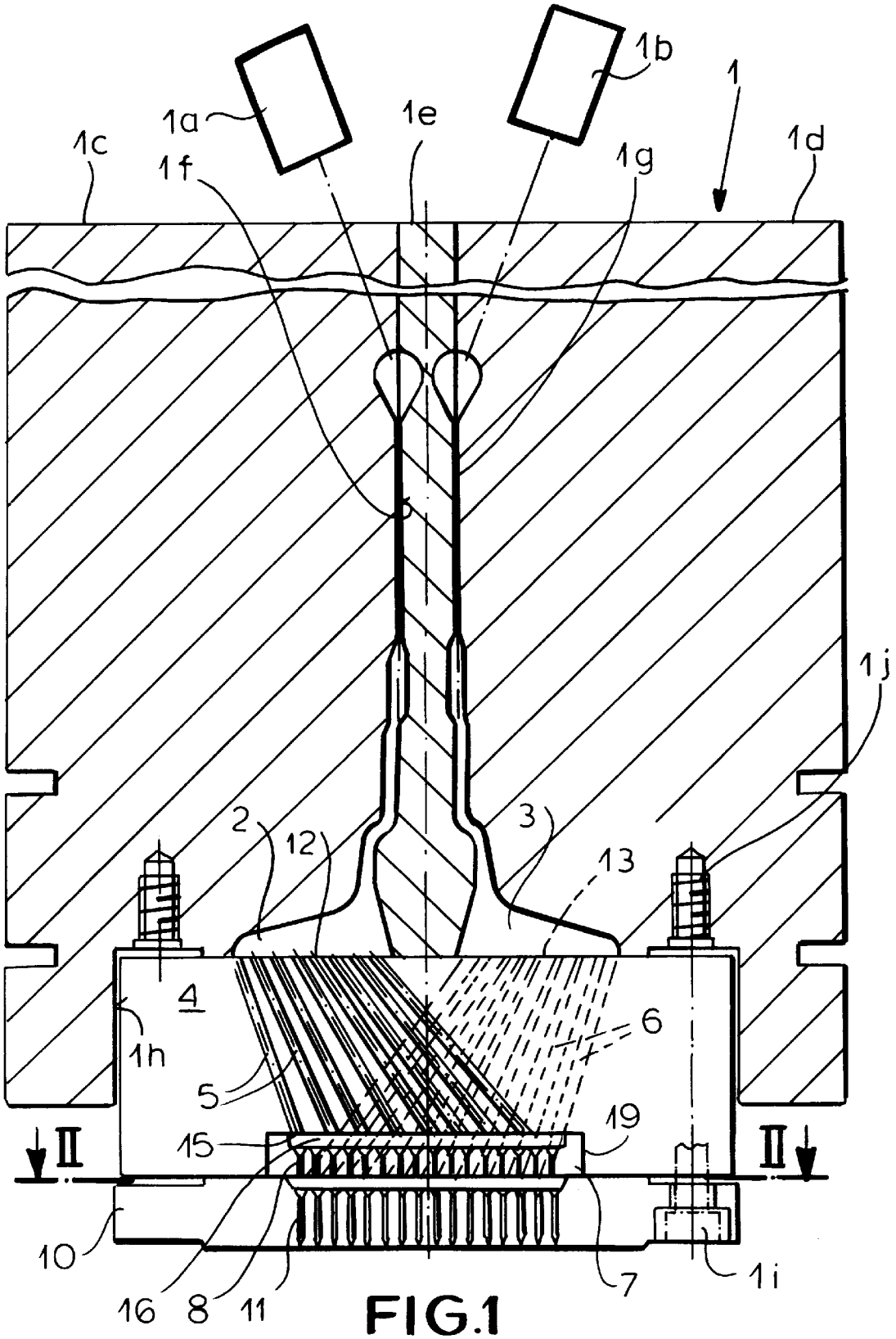
FIG. 1 is a transverse cross section through a spinning head according to the invention for the production of a set of bicomponent core/sheath filaments from two different thermoplastic synthetic resins, adapted to produce a spun fleece.

The apparatus shown in the drawing can be used to produce a spun fleece in which the filaments or fibers, depending upon whether the spun fleece is a spun bond or melt-blown product, are composed of a bicomponent composition of two different thermoplastic synthetic resins and have a core/sheath structure, hereinafter referred to as a core filament.

Basically, the apparatus comprises a two-channel wide-slit extrusion die 1 which can be connected to two plastifying or screw-type extruder units 1*a*, 1*b* for the different thermoplastic synthetic resin materials. The die 1 can be composed of two die bodies 1*c* and 1*d* flanking a central member 1*e* and the two channels can be thin passages if and 1*g*, respectively lying alongside the central member 1*e*.

At the bottom of the die, these channels if and 1*g* can terminate in two linearly extending, mutually parallel outlet slits 2 and 3 for the respective synthetic resin melts.

Figure 3:
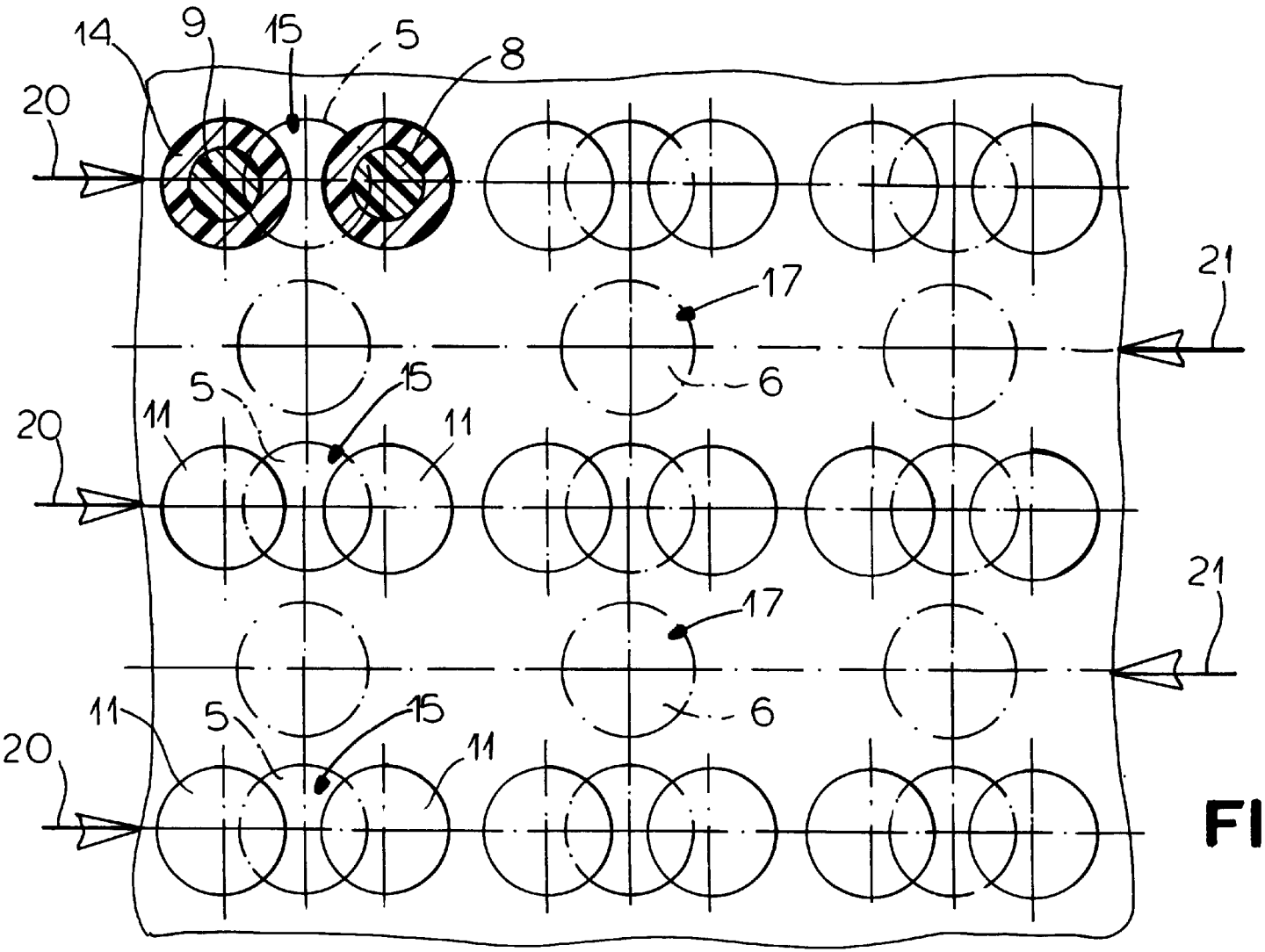
FIG. 3 is an enlarged detail view of the region III of FIG. 2.

On its underside, moreover, the die 1 is provided with a recess 1*h* in which a distributor plate 4 is received. The distributor plate 4 is formed with two sets of feed bores 5, 6 which are inclined oppositely and with a recess 19 in which a core-forming plate 7 is received. The core-forming plate 7 is provided with a rectangular array of core-forming bores 8 which are equally spaced both in the longitudinal direction (perpendicular to the plane of the paper in FIG. 1) and in the transverse direction. The longitudinal direction extends across the width of the fleece to be formed. The core-forming bores 8 have diameters corresponding to the diameters of the cores 9 of the filaments to be produced (see also FIG. 3).

The core-forming plate 7 is held in place by a spinneret plate 10 which is applied against the bottom of the distributor plate 4 and is secured by bolts 1*i* in the assembly. The bolts 1*i* are threaded into the internally threaded bores 1*j* of the die 1. The spinneret plate 10 is provided with spinneret bores 11 of a larger diameter than the bores 8. As can be seen from FIG. 1, the axes of the bores 8 and 11 coincide, i.e. the bores 8 register with the bores 11.

The feed bores 5 and 6 connect the bores 8 with the slit 2 and the bores 11 with the slit 3 as follows:

The inlets 2 of the feed bores 5 which deliver the core-forming thermoplastic synthetic resin melt open at the inlet slit 2 while the inlets 13 of the feed bores 6 for the sheath-forming thermoplastic melt open in the region of the slit 3. The sheath 14 has been illustrated in FIG. 3.

The outlets 15 of the feed bores 5 for the core-forming thermoplastic melt open into at least one upper distributor 16 of the core-forming plate 7. In practice, a distributor chamber 16 is provided for each transverse row of bores 8. The outlets 17 of the feed bores 6 for the sheath-forming synthetic resin melt are extended through the core-forming plate 7 (between the distributors 16) and open into at least one lower distributor chamber 18 provided above the spinneret bores 11 in the spinneret plate 10. In practice, only a single distributor 18 is required.

At ends of the distributor chambers 16, connecting passages perpendicular to the plane of the paper in FIG. 1 may connect these distributors together.

Figure 2:
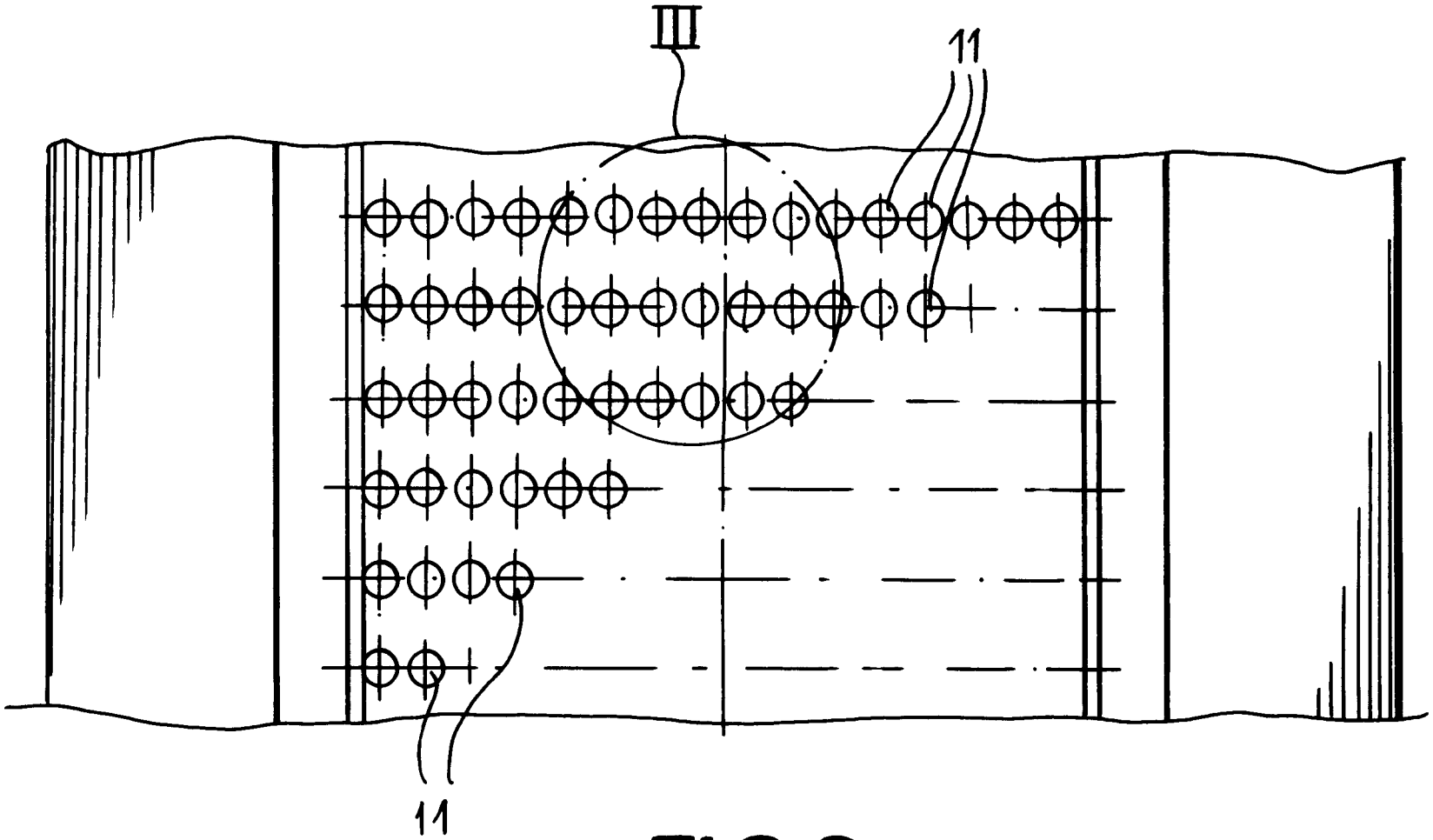
FIG. 2 is a section taken along the line II—II of FIG. 1.
Figure 4:
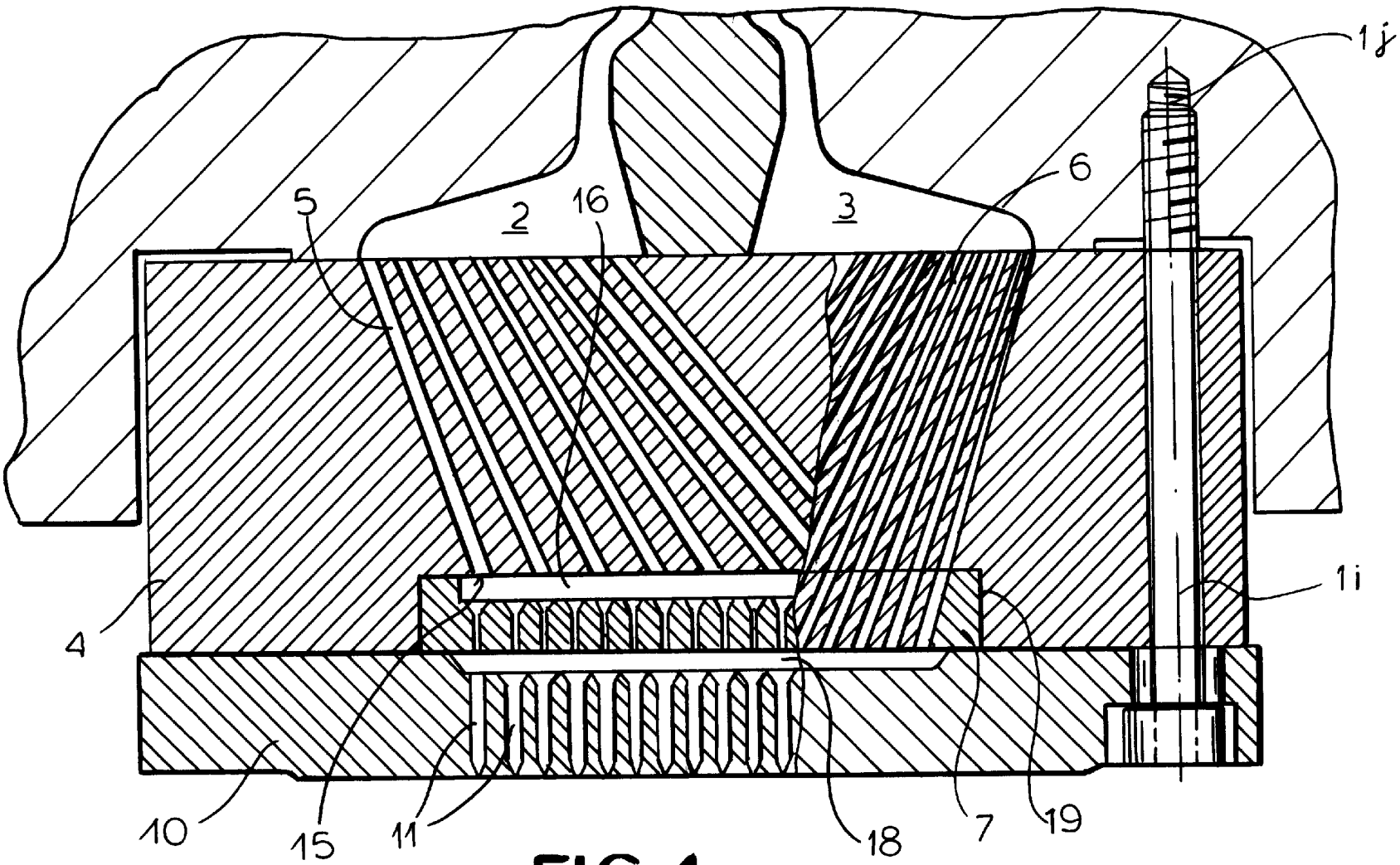
FIG. 4 is an enlarged section, partly broken away, showing the elongation of the feedbores for the sheath material through the core-forming plate.

As can be seen also from FIGS. 1 and 4 and as previously noted, the core-forming plate 7 can be received in the recess 19 of the distributor plate 4 so that it is held in place together with the spinneret plate 10 when bolted to the underside of the die 1. From FIGS. 2 and 3, it will be apparent that both the core-forming bores 8 and the spinneret bores 11 are disposed in a rectangular raster. The outlets 15 of the feed bores 5 for the core-forming material lie in transverse rows 20 between each two core-forming bores 8 so as to communicate with such bores in pairs. The outlets 17 of the feed bores 6 for the sheath-forming thermoplastic synthetic resin lie in transverse rows 21 between the rows 20 of the outlets 15 and between each two core-forming bores arranged in the longitudinal direction.

The system of the invention thus provides a curtain of core filaments which can be collected after cooling and stretching in accordance with the spun bond process to produce a fleece or can be subjected to jets of air to produce fibers which are collected in accordance with the melt-blown process to produce the fleece.

I Claim:

1. An apparatus for spinning a plurality of core filaments from two different thermoplastic synthetic resins, comprising:

a two-channel wide-slit extrusion die connected to sources of said thermoplastic synthetic resins and having two mutually parallel outlet slits opening downwardly at an underside of said two-channel wide-slit extrusion die and each discharging a respective one of said synthetic resins;

a distribution plate affixed to said underside of said two-channel wide-slit extrusion die and formed with two sets of oppositely inclined feed bores for conveying flows of the respective synthetic resins, the feed bores of each set having inlet ends communicating with the respective outlet slits;

a core-forming plate affixed at an underside of said distribution plate and formed with an array of through-going core-forming bores opening at an upper side of said core-forming plate into at least one upper distribution chamber, one of said sets of feed bores opening into said upper distribution chamber; and a spinneret plate affixed at an underside of said core-forming plate and provided with an array of through-going filament-forming bores aligned with respective ones of said core-forming bores whereby said core-forming bores extrude respective core-forming strands of the synthetic resin of said one of said sets of feed bores into the respective filament-forming bores, said filament-forming bores being of larger diameter than said core-forming bores and opening at a lower distribution chamber extending over the entire array and located at an upper side of said spinneret plate, the other of said sets of feed bores being extended beyond said core-forming plate to open into said lower distribution chamber whereby synthetic resin from said other of said sets of bores is extruded around said core-forming strands to form core filaments emerging from said filament-forming bores below said spinneret plate, said feedbores of said one of said sets having outlets in a transverse row and each opening between two of said core-forming bores, said feedbores of said other of said sets extending through said core-forming plate between said rows and opening between two spinneret bores aligned with one another in a longitudinal direction.

2. The apparatus defined in claim 1 wherein the core-forming plate is received in a recess formed on said underside of said distribution plate and is held together with said distribution plate and said spinneret plate by bolts threaded into said die.

3. The apparatus defined in claim 2 wherein said core-forming bores and said spinneret bores are arranged in rectangular raster patterns.

* * * * *